US007427299B2

(12) United States Patent
Ziakas

(10) Patent No.: US 7,427,299 B2
(45) Date of Patent: Sep. 23, 2008

(54) METHOD OF DISTRESSING A GARMENT

(76) Inventor: Kris T. Ziakas, 382 Richmond Ave., San Jose, CA (US) 95128

( * ) Notice: Subject to any disclaimer, the term of this patent is extended or adjusted under 35 U.S.C. 154(b) by 469 days.

(21) Appl. No.: 11/003,314

(22) Filed: Dec. 2, 2004

(65) Prior Publication Data

US 2006/0143770 A1 Jul. 6, 2006

(51) Int. Cl.
*D06Q 1/10* (2006.01)

(52) U.S. Cl. ..... 8/114.6; 8/114; 8/115

(58) Field of Classification Search ..... 8/114.6, 8/114, 115

See application file for complete search history.

(56) References Cited

U.S. PATENT DOCUMENTS 4,951,366 A * 8/1990 Geller ..... 26/28
5,090,056 A * 2/1992 Stoner et al. ..... 2/69
5,218,163 A * 6/1993 Dabrowski ..... 89/193
6,749,662 B2 * 6/2004 Bueneman et al. ..... 75/338

OTHER PUBLICATIONS

.45 ACP document (http://en.wikipedia.org/wiki/.45_ACP) May 4 2007.*

US News Article "Witness identifies stolen items found in Nichols' home" (www.cnn.com/US/9711/17/nichols.late/) Nov. 17, 1997.*

LA Times Article "Entrepreneur Takes Aim at Fashion Trend Business: New Hampshire man sells bullet-riddled clothing as a lark. But he's under fire by those who object to his high-caliber style." Jul. 23, 1994.*

Barrier, Michael, The niche is in the mall—Purple Mountain Dry Goods, http://www.findarticles.com/p/articles/mi_m1154/is_n4_v83/ai_16735290, Apr. 1995, 2 pgs.

* cited by examiner

*Primary Examiner*—Lorna M. Douyon
*Assistant Examiner*—Amina Khan
(74) *Attorney, Agent, or Firm*—Manatt, Phelps and Phillips, LLP; Imran A. Khaliq

(57) ABSTRACT

In order to create or emulate authentic shotgun holes in a garment, a garment is subject to a distressing process with projectiles or other distressing apparatuses. A garment may be distressed without comprising critical components of the garment by positioning it in a stationary form in relation to a distressing apparatus and protecting the garment with a garment protection apparatus. A button for a garment is created by utilizing an authentic shotgun shell base attached to a rivet and spacer.

12 Claims, 5 Drawing Sheets

METHOD OF DISTRESSING A GARMENT

FIELD OF THE INVENTION

This invention relates to a method of distressing a garment, such as Jeans, pants, tee-shirts, jackets and other clothing items and accessories.

BACKGROUND OF THE INVENTION

In recent years the fashion industry has embraced the look of distressed, faded, and tattered looking clothing. Several major fashion designers are now taking new clothes and making them look old and worn out. One of the most popular fashions of clothing to "distress" are Jeans.

In the classic sense, Jeans are casual pants made of heavyweight indigo denim, typically featuring five pockets, six rivets, contrast stitching, five to seven belt loops and a zip or button fly. Jeans date back to the mid 1800's when a workwear manufacturer Levi Strauss & Co. and tailor Jacob Davis together patented the use of rivets as reinforcement to hold pockets and Jeans together so they would not tear. When Strauss and Co. introduced copper riveted 'waist overalls', as Jeans were then known, they became an instant success for their durability and rugged feel. In the early 20th century Jeans were traditionally worn by outdoor workers, cowboys, and ranchers. However, since the 1930's Jeans have transcended their conventional status as workmen's clothing and have now become fashionable clothing worn by just about everyone.

In early 20th century, Jeans were made by only a handful of clothing manufacturers such as Levi Strauss and Co., Lee® and Wrangler®. They became quickly known for the comfort, affordability and versatility. Since the 1980s, however, almost every major manufacturer is carrying its own line of jeans.

It is well known to consumers of Jeans and those in the Jean industry that brand new Jeans take months of wearing and washing before they become faded and well-worn. To many, the worn-in and worn-out look is a desirable and comfortable clothing item. To meet this demand for worn out or "distressed" clothing, designers have been marketing "faded", "stonewashed", "acid washed", "enzyme washed" and "crushed" Jeans as popular clothing items. In order to create distressed looking clothing, Jean manufacturers have in the past employed various combinations of physical and chemical processes, including sanding with sandpaper, washing with pieces of pumice stone, and using bleaching agents and enzymes to "biopolish" and create a "stonewashed" look. However, there is a demand in the market for even more distressed looking clothing, beyond the tattered and worn out look.

In order to create the ultimate distressed look, some in the fashion industry have experimented with Jeans that feature mock bullet holes and shot-gun blasts. One retailer, Gambino Jeans (see www.gambinoJeans.net), sells Jeans that have holes reflecting mock shotgun blasts. However, these Jeans do not have the authentic distressed look of actual bullet holes and do not emulate actual shotgun blasts.

What is desired therefore is to create Jeans and other garments that can be safely distressed with actual gunfire, projectiles or other distressing apparatuses to yield clothing products which feature actual bullet holes or emulate such holes. However, discharging a projectile at a garment or puncturing a garment or accessory can not only be dangerous, but can easily damage or compromise critical components of the garment such as buttons and zippers. Bullets and shotgun pellets can easily ricochet and end up in places beyond the shooters control. Therefore, what is desired is a method and process of distressing a garment with a distressing apparatus to create or emulate bullet holes in a safe, consistent, and reliable manner.

DETAILED DESCRIPTION OF THE INVENTION

Various embodiments of the present invention are described hereinafter with reference to the figures. Elements of like structures or functions are represented with like reference to numerals throughout the figures. The figures are only intended to facilitate the description of some of the embodiments of the invention. They are not intended as an exhaustive description of the invention or as a limitation on the scope of the invention. In addition, an aspect described in conjunction with one embodiment of the present invention is not necessarily limited to that embodiment and can be practiced in conjunction with any other embodiments of the invention.

In accordance with one embodiment of this invention, a garment, such as a pair of Jeans, is securely attached to a garment support, preferably, Gridcore® to position it in a stationary form. A garment protection apparatus, is slipped over the zipper and button area to shield it from the spray of projectiles which can damage the zipper and button. A clamp is used to secure the garment protection apparatus to the Jeans, which can also be used to attach the Jeans to a Gridcore® support. After propping against a Gridcore® support, the Jeans are presentable to be distressed by a shooter, who can then fire a projectile, preferably, a 12 gauge shotgun shell, at a measured distance to achieve the desired distressed look.

In another embodiment of the invention, the garment may be distressed with a number of different types of distressing apparatuses, including, but not limited to shotguns of different caliber such as 4, 8, 10, 14, 16, 24, 28, 32 and 410 gauge shotguns.

In another embodiment of the present invention Jeans are distressed using shotguns that fire a number of different types of pellets or ball shot. The ball shot or pellets can be made of material including but not limited to lead, bismuth, steel, tungsten-iron, tungsten-nickel-iron and tungsten polymer loads. The shot or pellet includes but is not limited to "buckshot", "steelshot", and "birdshot" of various sizes.

In yet another embodiment of the invention, a specific number of shotgun pellets are measured and then poured into a shotgun cartridge in order to achieve the desired distressed look. For example, if one desires more bullet holes and a higher level of distress, a higher quantity of pellets can be poured into the shotgun cartridge for subsequent discharge at the garment.

The preferred articles made with this process include but are not limited to jeans, pants, shirts, jackets, sweaters, hats, gloves, shorts, vests, suits, dresses, tank-tops, scarves, shoes, handbags, purses, wallets and other clothing items and accessories.

Figure 5:
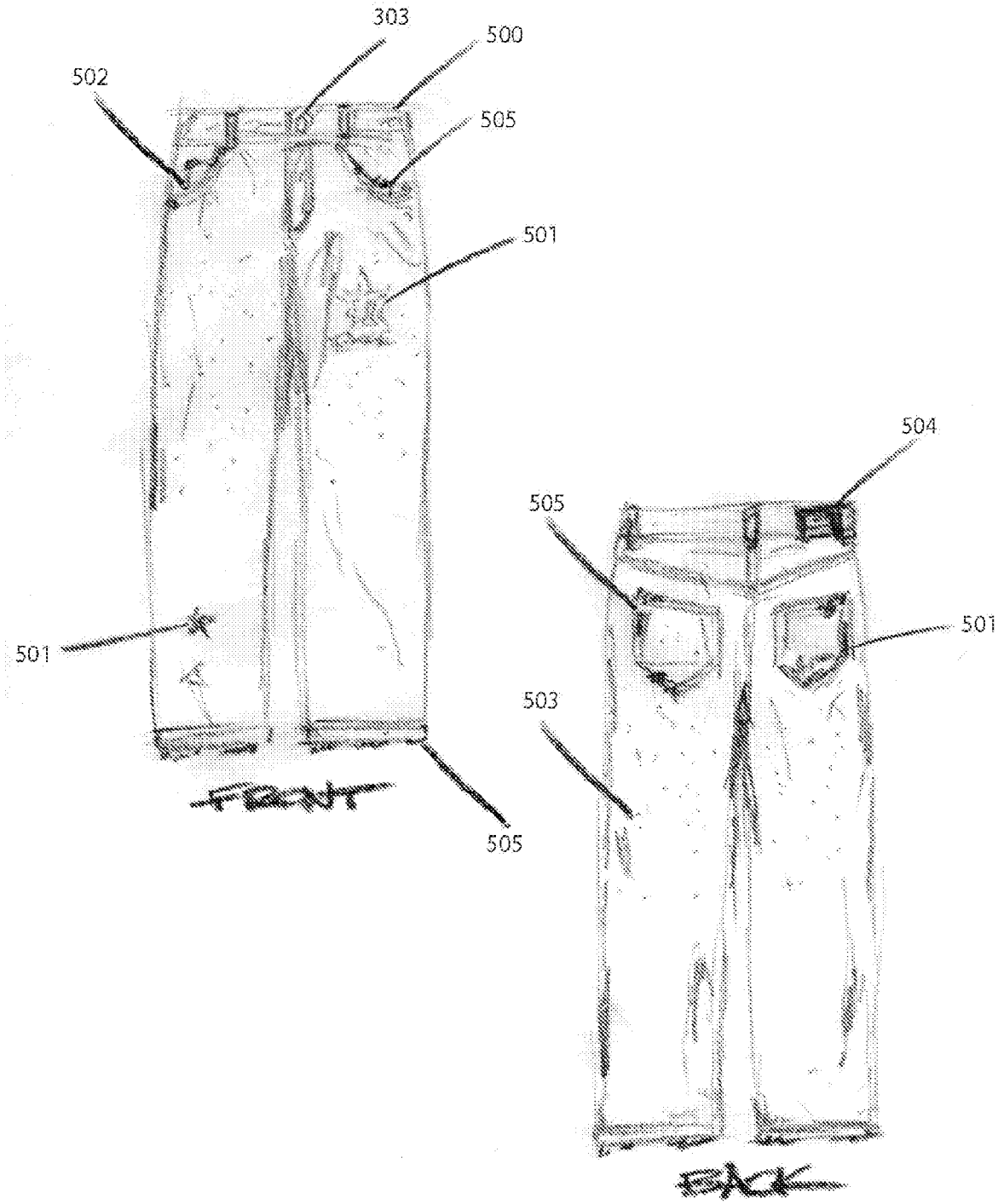
FIG. 5. is a front and back view of a finished product pair of Jeans obtained by the method and process of this invention, illustrating the desired distressed look.

In a preferred embodiment of this invention, a pattern for a 5 pocket jean is created, sized and graded using any conventional means. A denim fabric is selected, cut, and sewn according to the selected pattern and grade. Next the trim is added to the denim such as the zipper and pocket rivets. At this stage, initial distressing (for e.g. sandblasting or handtattering) can be applied to the Jeans. The Jeans can be further rinsed and washed to create a preliminary distressed look. In a preferred embodiment of this invention, silk screen design art 501 is applied to the left thigh area and additionally to the rear pocket and right front lower leg area as shown in FIG. 5.

Figure 1:
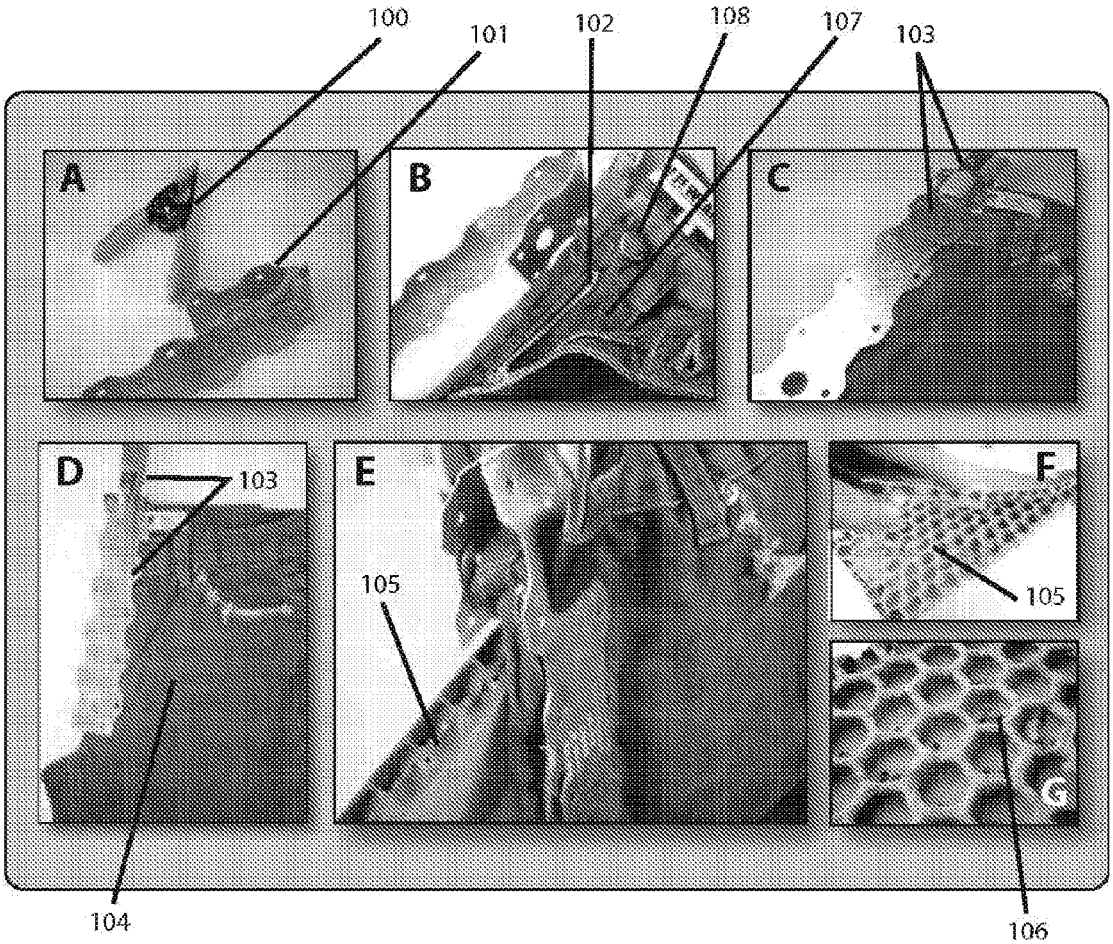
FIG. 1A-G. illustrates the steps required to secure the garment to a garment support in preparation for safely distressing the garment with a shotgun.

FIG. 1. illustrates a preferred method of securing a garment such as a pair of Jeans 104 to a garment support 105 in preparation for distressing the garment. The purpose of the garment support 105 is to support the garment and absorb the force of the distressing apparatus and projectile. Other means of positioning a garment in a stationary form in order to effectively distress the garment are encompassed by the invention.

FIG. 1A. illustrates a metal clamp 100 and a formed piece of metal sheet 101, which in one embodiment of the invention make up the garment protection apparatus 103. The purpose of the garment protection apparatus 103 is to shield the zipper 102 and button 108 from projectiles which can compromise critical components of the garment. In other embodiments of the invention, the garment protection apparatus 103 can be substituted with a garment protection apparatus of similar or different design to protect, for example, the buttons or neckline of a shirt, or a zipper of a jacket etc.

FIG. 1B. illustrates a pair of Jeans 104 with a zipper 102 and button 108, which in one embodiment of the invention are the critical components of the garment to be protected by the garment protection apparatus 103.

FIG. 1C. illustrates one embodiment of the invention, where the metal clamp 100 and formed piece of sheet metal 101 make up a garment protection apparatus 103, which can be attached across the zipper area 107 of a pair of Jeans 104.

FIG 1D. illustrates one embodiment of the invention showing the garment protection apparatus 103 attached lengthwise across the zipper area 107 to a pair of Jeans 104, which is folded horizontally in order to allow shotgun pellets to penetrate both legs of the pants. However, in other embodiments of the invention, the garment can be positioned, folded, arranged and secured in other configurations.

FIG 1E. illustrates a top view of one embodiment of the invention where the Jeans 104 and garment protection apparatus 103 are secured to garment support 105, which in a preferred embodiment is a piece of Gridcore®. Gridcore® is a specially engineered structural board made from recycled paper, cardboard and agricultural fibers which has an internal honeycombed shaped configuration which in one particular embodiment of the invention is suitable for catching gun shots and pellets. Due to the concern with lead based metals left in the soil and contaminating the underground water supply, there exists a need to implement a method whereby gun pellets discharged outdoors can be safely retrieved after discharge. Thus, this invention contemplates that use of materials including and not limited to metal, wood, cork, heavy cardboard, rubber, plastic, sand and other materials which can be ideal for catching or absorbing projectiles, bullets, pellets and shot before they hit the ground. It should be emphasized that the inventive method is not limited to using Gridcore® to retain the projectiles and that any other material suitable to absorb the force of projectiles could also be substituted for Gridcore® in this embodiment. After the garment is secured in a stationary position and the appropriate areas of the garment are protected with the garment protection apparatus 103, it is presentable for distressing.

In a preferred embodiment, a 28" barrel, 12 gauge (12 GA) shotgun set at skeet or cylinder setting is used as the distressing apparatus to dispel the gunshot for purposes of distressing the garment. However, it should be emphasized that other types of distressing apparatuses for making a plurality of holes in a garment are contemplated by this invention. For example, the invention contemplates that various caliber guns can be used for distressing the garment. The caliber of shotguns is measured in terms of gauge or bore. The gauge number is determined by the number of solid spheres of a diameter equal to the inside diameter of the barrel that could be made from a pound of lead. The present invention is not limited to use of 12 gauge shotguns. Shotguns of different gauges including but not limited to 4, 8, 10, 14, 16, 24, 28, 32 and 410 gauge shotguns may be used in this invention with barrel lengths ranging from, but not limited to 26" to 28". Also the invention contemplates the use of rifles and guns of different caliber including but not limited to .22, .25, .308, .32, .357, .38, .380, .40, .44, .45, and .50 caliber rifles and guns. A caliber of a gun or rifle refers to the diameter of the inside of the barrel and is typically measured in inches. The caliber is expressed in either hundredths or thousandths of an inch, thus .22 caliber is 0.22 inches. Additionally, the invention contemplates emulating the effect of shotgun holes on a garment which can be created by other distressing apparatuses and means such as by use of a BB gun, spike press, ice pick, hammered on bas relief or other suitable means and objects.

Different types of projectiles, bullets, shot or pellets can be employed to distress a garment in a given embodiment of the invention. In a preferred embodiment, #8 lead shot is used as the shot or pellet of choice because it is ideal for creating the appropriate type of hole and is not unduly harsh on the garment. An desired amount of shot is filled in a shotgun shell depending on the desired amount of distress to be applied to the garment. The following charts show by way of example different types of shot or ammunition that can be implemented in several different embodiments of the invention, depending on the type of distress desired:

| LEAD SHOT Shot Number | Diameter (inches) | Diameter (mm) | Approx Number. of Pellets in 1 oz. |
|---|---|---|---|
| 000 BUCK | .36 | 9.14 | 6.2 |
| 00 BUCK | .33 | 8.38 | 8 |
| 0 BUCK | .32 | 8.13 | 9 |
| 1 BUCK | .30 | 7.62 | 11 |
| 2 BUCK | .27 | 6.86 | 15 |
| 3 BUCK | .25 | 6.35 | 19 |
| 4 BUCK | .24 | 6.10 | 21 |
| BB | .18 | 4.57 | 50 |
| 2 | .148 | 3.76 | 90 |
| 4 | .129 | 3.28 | 135 |
| 5 | .120 | 3.05 | 170 |
| 6 | .109 | 2.77 | 225 |
| 7.5 | .094 | 2.39 | 350 |
| 8 | .089 | 2.26 | 410 |
| 8.5 | .085 | 2.16 | 470 |
| 9 | .079 | 2.01 | 585 |
| 12 | .05 | 1.3 | 2300 |

| STEEL SHOT Shot Number | Diameter (inches) | Diameter (mm) | Approx. Number of Pellets in 1 oz. |
|---|---|---|---|
| F | .22 | 5.59 | 40 |
| T | .20 | 5.08 | 53 |
| BBB | .19 | 4.83 | 61 |
| BB | .18 | 4.57 | 72 |
| 1 | .16 | 2.79 | 103 |
| 2 | .15 | 3.05 | 125 |
| 3 | .14 | 3.30 | 154 |
| 4 | .13 | 3.56 | 191 |
| 5 | .12 | 3.81 | 244 |
| 6 | .11 | 2.79 | 317 |
| 7 | .10 | 2.54 | 422 |

Figure 4:
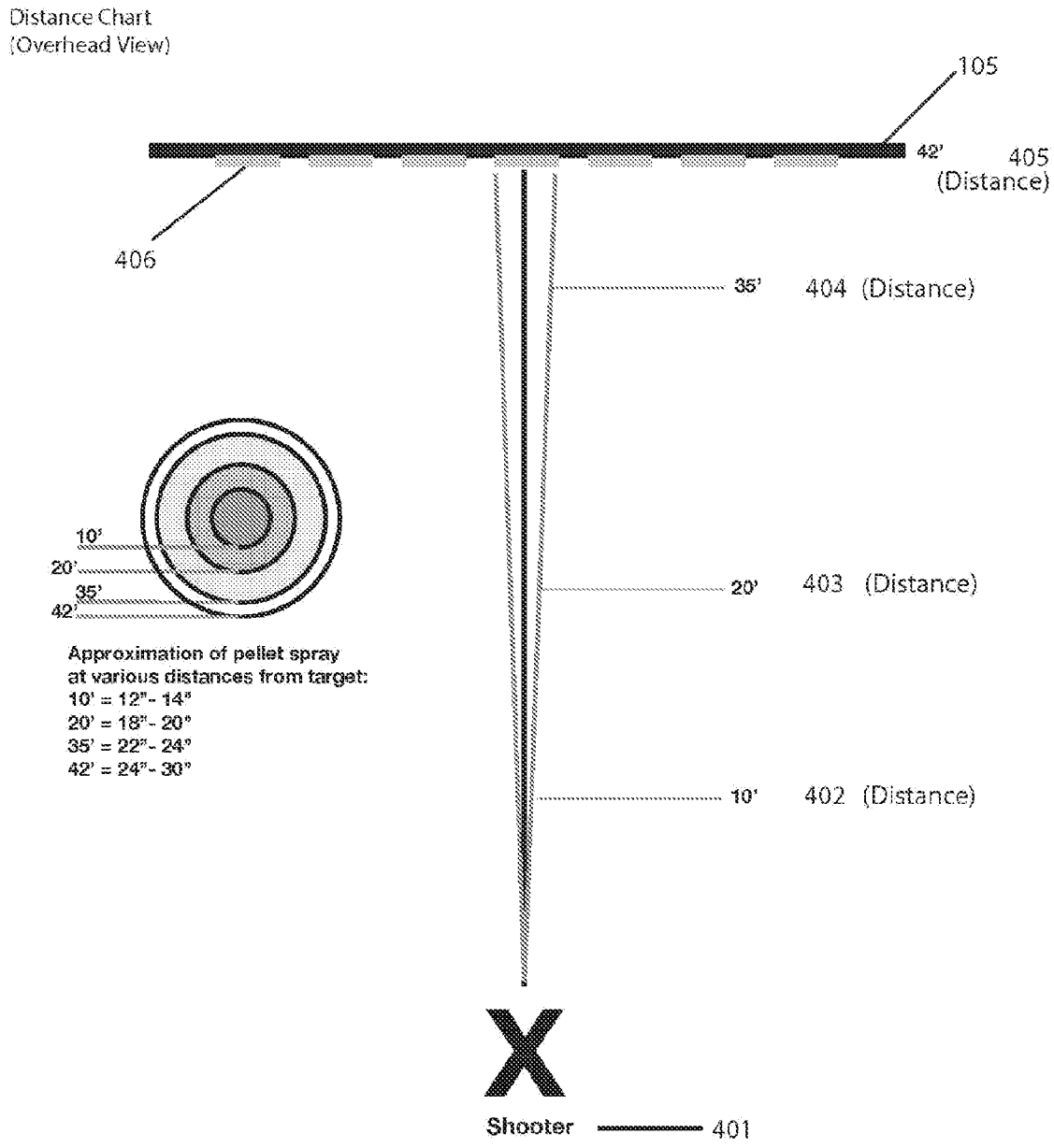
FIG. 4. is a distance chart which illustrates the approximate pellet spray ranges based on the distance of the shooter from the target garment.

According to one embodiment of the invention, after the garment is secured in a stationary position to garment support 105 as shown in FIG 1E, and the desired distressing apparatus is selected, a shooting distance is measured off between the garment and the shooter (see FIG. 4 Distance Chart which illustrates the approximation of pellet spray in inches at various distances from the target garment 406). The shooter then safely positions himself at a predetermined distance (see FIG. 4, 401-404) and dispels the desired rounds of gun shot or other suitable projectile at the target garment 406 in order to achieve the preferred distressed look. In a preferred embodiment, the shooter places himself at a distance of 35 to 42 feet from the garment and fires #8 lead shot. This distance and projectile combination has been used to create a preferred type of distress in the garment.

FIG. 1 shows one embodiment of the invention where a pair of Jeans 104 is shot with a 12 gauge shot gun using #8 lead shot against a garment support 105. FIG 1F shows the layers of the garment support 105 separated to reveal their honeycombed shaped interior.

FIG. 1G illustrates another advantage of this invention, where the fired shot 106 is retained within the inner cavities of the garment support 105. The shot 106 is gathered for subsequent use. It should be noted that any material contemplated by this invention which is suitable for retaining gun shots after discharge protects the ground from stray lead that may seep into underground water supplies.

Figure 2:
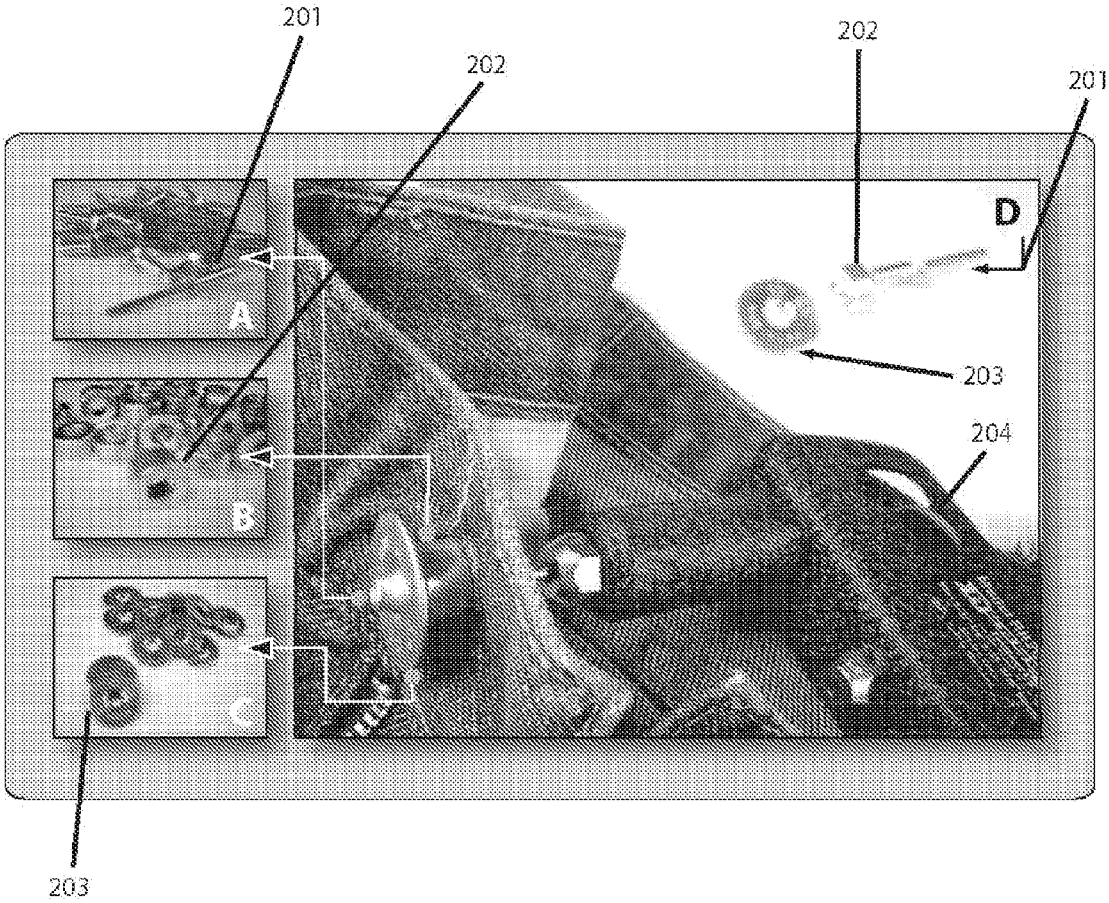
FIG. 2. illustrates the method of attaching a shotgun shell base using a rivet to form a button for the Jeans.

FIG. 2. illustrates another embodiment of the invention whereby an authentic machined 12 gauge shotgun shell base 203 is used to create the button for Jeans 104. FIG. 2A shows the rivets used in constructing the button, which in this example comprise ⅜"×⅝" aluminum countersunk rivets 201. FIG. 2B shows the aluminum ⅜"×¼" flat spacer 202 which comprises another component of the button. It should be noted that in other embodiments of the invention other types of rivets and spacers of varying composition and size can be substituted for the aluminum countersunk rivets and aluminum flat spacers used in this example. The substitution of rivets and flat spacers in other embodiments of the invention may depend for example on the use of different type of shotgun shell bases of varying gauge and diameter. FIG. 2C shows a 12 gauge shotgun shell base 203 which has been machined, using a metal lathe and a cutting tool. Additionally, the striking pin is removed with a 12 gauge shell reloading tool. It should be noted that any conventional means known by one with ordinary skill in the art can be used to machine the shotgun shell base 203 to fit the ⅜"×⅝" aluminum rivet 201 and aluminum ⅜"×¼" flat spacer 202.

FIG. 2D shows a hand riveting tool 204 which is used to attach the aluminum countersunk rivet 201, an aluminum flat spacer 202 and the machined 12 gauge shotgun shell base 203 at the waist area of Jeans 104.

Figure 3:
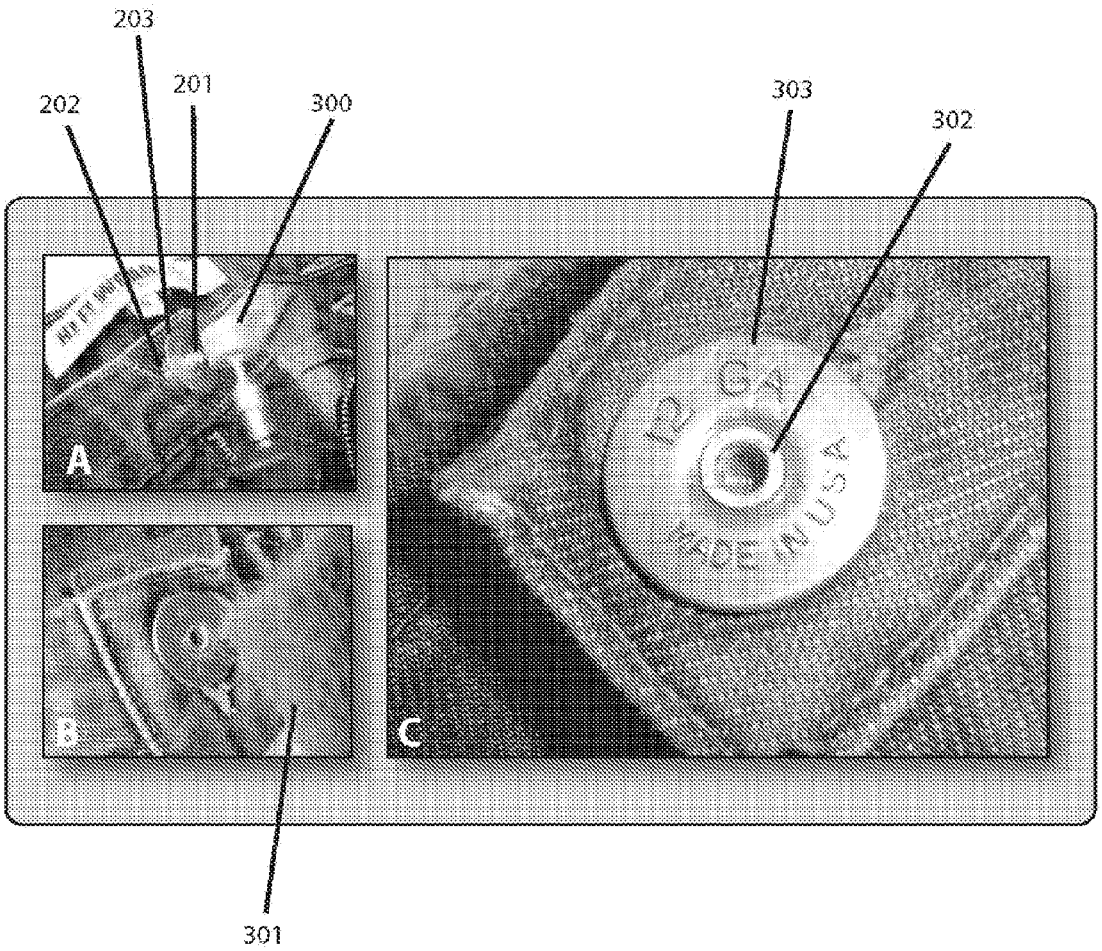
FIG. 3. illustrates the final steps in the process of grinding down the rivet to form the finished 12 gauge machined shotgun shell to be used as a button for the Jeans.

FIG. 3 illustrates the final procedure applied to the button formed in FIG. 2, which is further processed to form the finished button 303. FIG. 3A shows a grinding apparatus 300, for example a Dremel® tool, which is used to grind down the excess amount of countersunk rivet 201 which protrudes from the shotgun shell base 203. FIG. 3B shows a buffing material 301 which is used to remove any burrs from the grinding process shown in FIG. 3A. It should be noted that any suitable grinding instrument and buffing material can be substituted for the grinding apparatus 300 and buffing material 301 used in FIG. 3A, and 3B. FIG. 3C shows the finished button 303, which in this example is an authentic 12 GA shotgun shell base. In other embodiments of the invention a variety of other shotgun shell bases of different gauge can be substituted for the 12 GA shotgun shell base used as the button in this particular embodiment. It should be noted that the use of authentic shotgun shell bases as buttons encompasses only one aspect the inventive product, and other types of buttons may be utilized if so desired.

FIG. 4 is a distance chart which shows the approximate pellet spray range of shotgun pellets depending on the distance of the shooter 401 from the target garment 406. The invention contemplates that the shooter can measure off various distances from the garment 406 in order to achieve the desired density of gun shot or bullet holes on the target garment 406. In this example a garment 406 is attached to a garment support 105. The chart shows that at distance 402 (10 feet) from the target garment 406, the approximate pellet spray range spans a 12" to 14" diameter from the center of the target garment 406. At distance 403 (20 feet) from the target garment 406 the approximate pellet spray range spans a 18" to 20" diameter from the center of the target garment 406. At distance 404 (35 feet) from the target garment 406 the approximate pellet spray range spans a 22" to 24" diameter from the center of the target garment 406. At distance 405 (42 feet) from the target garment 406 the approximate pellet spray range spans a 24" to 30" diameter from the center of the target garment 406. The preferred distances for the shooter 401 to stand from the target garment 406 are 35 feet and 42 feet, respectively, from the garment.

FIG. 5 shows a front and back view of a finished garment according to this invention. In this example a pair of distressed Jeans 500 is shown. In this particular embodiment of the invention, a silk-screened printed image 501 can be applied to the garment at various locations on the garment either before or after distressing the garment with a distressing apparatus. The trim and rivets 502 are additional features of the distressed Jeans 500. Authentic shotgun holes 503 are also illustrated in this example. Also in this embodiment, a faux leather tag 504 is sewn on the back of the upper right hand corner along the waistline of the distressed Jeans 500. Furthermore, distressed Jeans 500 can be subject to additional distressing illustrated by 505. Additional distressing of the garment can occur either before or after the garment is subject to distress by a distressing apparatus or other means of emulating shotgun holes. Additional methods of distressing include but are not limited to sandblasting, tearing, stonewashing, enzyme-washing acid-washing, bleaching, beadblasting, hand-sanding, cheese grating, dyeing and conventional washing and drying. Additional distressing is contemplated by the invention in order to enhance the distressed look and feel of the garment. Also, other embodiments of the invention contemplate the addition of other features to the product of the inventive process such embroidery, ink-stamps, spray paint, enzyme dyes, etching, bleach stains, branding, and liquid emulsion.

In a preferred embodiment of the invention, after a pair of Jeans are subjected to the distressing process other additional structures or novelty items are added to the Jeans such as a metal shot date tag bearing a company logo or trademark and the date stamp indicating the day the Jeans were distressed with gun shots. Furthermore, a spent shell or spent round is attached to the Jeans along with samples of steel shot which are attached to the Jeans in a consumer safe pouch. Additional items are added to the distressed garment such as a hand-printed chipboard product consumer tag which in the preferred embodiments is inserted into the rear right pocket or front left thigh.

Although the invention has been described with reference to a particular arrangement of parts, features and the like, these are not intended to exhaust all possible arrangements or features, and indeed many other modifications and variations will be ascertainable to those skilled in the art.

What is claimed is:

1. A process of distressing a wearable garment with a shotgun comprising:

providing said garment;

positioning said garment on a projectile absorbing garment support in a stationary form in relation to a distressing apparatus;

shielding a predetermined portion of said garment with a garment protection apparatus;

said predetermined portion comprising the zippers or buttons of the garment;

positioning a distressing apparatus, comprising a shotgun, at a predetermined distance from said garment;

discharging a shotgun shell using said shotgun at said wearable garment at a predetermined distance and creating a plurality of holes in said garment with shotgun shot with a distressing apparatus while not compromising critical components of the garment protected by said garment protection apparatus, while giving said garment an authentic firearm distressed look and feel;

wherein said projectile absorbing garment support is capable of catching shotgun shot.

2. The process defined in claim 1 wherein the garment is selected from the group consisting of jeans, pants, shirts, jackets, sweaters, shorts, vests, suits, dresses, tank-tops, hats, gloves and scarves.

3. The process defined in claim 2 wherein the garment is made of fabric selected from the group consisting of 6 to 16 ounce denim, corduroy, wool, cotton, nylon, canvas, burlap, leather, suede, nagohide, tweed and cotton twill.

4. The process defined in claim 1 wherein the garment can be substituted with an accessory selected from the group consisting of shoes, handbags, purses and wallets.

5. The process defined in claim 1 wherein the garment is positioned in a stationary form against a garment support selected from a group consisting of cardboard, wood, plastic, metal, sand, rubber, cork and tire.

6. The process defined in claim 1 wherein the distressing apparatus is selected from the group consisting of shotguns of gauge 4, 8, 10, 12, 14, 16, 24, 28, 32 and 410.

7. The process defined in claim 6 wherein the shotgun discharges projectiles selected from the group consisting of buck shot, lead shot and steel shot.

8. The process defined in claim 7 wherein a specific number of shot are poured into a shotgun cartridge in order to achieve the desired distressed look.

9. The process defined in claim 7 where a pair of jeans is shot with a 12 gauge shotgun using #8 lead shot against a garment support.

10. The process defined in claim 7 where a shooter discharges a shotgun at a predetermined distance of 10, 20, 35, or 42 feet from the garment.

11. A process of producing a wearable, distressed garment comprising:

providing a garment suitable for wear by a consumer;

positioning said garment on a projectile absorbing garment support in a stationary form in relation to a distressing apparatus, said distressing apparatus comprising a shotgun device capable of firing shot using an explosive shell;

wherein said projectile absorbing garment support is capable of catching shotgun shot;

protecting a predetermined portion of said garment from shotgun spray damage with a garment protection apparatus; said predetermined portion comprising the zippers or buttons of the garment;

positioning said distressing apparatus at a predetermined distance from said garment;

firing a shell at the stationary garment to create a plurality of holes in said garment, but not in said predetermined portion, to give said garment an authentic firearm distressed look and feel.

12. The process of claim 11 wherein the predetermined distance is selected from a set of distances comprising 10, 20, 35, or 42.

* * * * *